US010710614B2

(12) United States Patent
Taga et al.

(10) Patent No.: US 10,710,614 B2
(45) Date of Patent: Jul. 14, 2020

(54) WHEEL LOAD ADJUSTING TOOL OF RAILCAR BOGIE, RAILCAR BOGIE INCLUDING THE SAME, AND METHOD OF MANUFACTURING RAILCAR BOGIE

(71) Applicant: KAWASAKI JUKOGYO KABUSHIKI KAISHA, Kobe-shi, Hyogo (JP)

(72) Inventors: Yukitaka Taga, Kobe (JP); Fumikazu Kounoike, Kakogawa (JP); Yukihiro Sano, Kobe (JP); Takaya Ono, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 261 days.

(21) Appl. No.: 16/065,865

(22) PCT Filed: Nov. 29, 2016

(86) PCT No.: PCT/JP2016/005004
§ 371 (c)(1),
(2) Date: Jun. 25, 2018

(87) PCT Pub. No.: WO2017/110044
PCT Pub. Date: Jun. 29, 2017

(65) Prior Publication Data

US 2019/0009800 A1 Jan. 10, 2019

(30) Foreign Application Priority Data

Dec. 25, 2015 (JP) ..... 2015-252984

(51) Int. Cl.
*B61F 5/30* (2006.01)
*B61F 15/20* (2006.01)
*B61F 5/36* (2006.01)

(52) U.S. Cl.
CPC ..... *B61F 5/302* (2013.01); *B61F 5/36* (2013.01); *B61F 15/20* (2013.01)

(58) Field of Classification Search
CPC ..... B61F 5/301; B61F 5/302; B61F 5/304; B61F 5/32; B61F 5/36; B61F 15/20
See application file for complete search history.

(56) References Cited

U.S. PATENT DOCUMENTS 5,039,071 A * 8/1991 Irle ..... B61F 5/308 267/52
6,338,300 B1 * 1/2002 Landrot ..... B61F 5/305 105/182.1

(Continued)

FOREIGN PATENT DOCUMENTS

JP H11-105709 A 4/1999
WO 2013/150720 A1 10/2013

*Primary Examiner* — Jason C Smith
(74) *Attorney, Agent, or Firm* — Oliff PLC

(57) ABSTRACT

A wheel load adjusting tool includes at least one liner interposed between an axle box and a spring directly or indirectly supported by the axle box, the liner including: a pressure receiving portion configured to receive a load applied from the spring; a first engaging portion formed by recessing a part of an outer edge of the pressure receiving portion inward, the first engaging portion engaging with a first engaged portion to restrict the liner from being displaced with respect to the axle box, the first engaged portion projecting from an upper surface of the axle box; and a second engaging portion projecting outward from the pressure receiving portion at an opposite side of the first engaging portion, the second engaging portion engaging with a second engaged portion of the axle box to restrict the liner from being displaced and rotated with respect to the axle box.

8 Claims, 7 Drawing Sheets

(56) References Cited

U.S. PATENT DOCUMENTS

| | | | | |
|---|---|---|---|---|
| 2014/0137765 | A1* | 5/2014 | Nishimura | B61F 5/00 105/182.1 |
| 2015/0083019 | A1* | 3/2015 | Nishimura | B61F 5/36 105/197.05 |
| 2015/0114252 | A1* | 4/2015 | Sato | B61F 5/22 105/199.1 |
| 2016/0082985 | A1* | 3/2016 | Nishimura | B61F 5/14 105/197.05 |
| 2016/0320229 | A1* | 11/2016 | Nishimura | B61F 5/308 |
| 2018/0029617 | A1* | 2/2018 | Okumura | B61F 5/52 |
| 2018/0312176 | A1* | 11/2018 | Nishimura | B61F 5/305 |
| 2018/0327003 | A1* | 11/2018 | Nishimura | B61F 5/10 |
| 2018/0370550 | A1* | 12/2018 | Nishimura | B61F 5/302 |
| 2019/0009799 | A1* | 1/2019 | Taga | B61F 5/302 |
| 2019/0009800 | A1* | 1/2019 | Taga | B61F 15/20 |
| 2019/0016352 | A1* | 1/2019 | Taga | B61F 5/00 |
| 2019/0016354 | A1* | 1/2019 | Nishimura | B61F 5/302 |
| 2019/0291753 | A1* | 9/2019 | Ono | B61F 3/02 |
| 2019/0329659 | A1* | 10/2019 | Tamura | B61F 5/302 |
| 2019/0375436 | A1* | 12/2019 | Tamura | B61F 5/30 |
| 2020/0047778 | A1* | 2/2020 | Kounoike | B61F 5/52 |
| 2020/0062282 | A1* | 2/2020 | Hoffmann | B61F 5/386 |

* cited by examiner

WHEEL LOAD ADJUSTING TOOL OF RAILCAR BOGIE, RAILCAR BOGIE INCLUDING THE SAME, AND METHOD OF MANUFACTURING RAILCAR BOGIE

TECHNICAL FIELD

The present invention relates to a wheel load adjusting tool of a railcar bogie, a railcar bogie including the wheel load adjusting tool, and a method of manufacturing a railcar bogie.

BACKGROUND ART

In a railcar bogie, an axle box accommodating a bearing rotatably supporting a wheelset is supported by a bogie frame through an axle box suspension (see PTL 1, for example).

For example, in the bogie of PTL 1, wheel load adjusting work of adjusting wheel load balance among wheels is performed by inserting a liner between an axle box and an axle spring or pulling out the inserted liner to change a spring constant.

CITATION LIST

Patent Literature

PTL 1: Japanese Laid-Open Patent Application Publication No. 11-105709

SUMMARY OF INVENTION

Technical Problem

In a plan view, the liner has a substantially C shape obtained by cutting out a part of a circle. There is a possibility that when the liner is inserted between the axle box and the axle spring, the position of the liner is not completely fixed, and the liner is displaced or rotated in a horizontal plane.

An object of the present invention is to prevent a positional displacement of a liner interposed between an axle box and a spring in a railcar bogie while improving a working property when attaching and detaching the liner.

Solution to Problem

A wheel load adjusting tool of a railcar bogie according to one aspect of the present invention is a wheel load adjusting tool including at least one liner interposed between an axle box and a spring directly or indirectly supported by the axle box, the liner including: a pressure receiving portion configured to receive a load applied from the spring; a first engaging portion formed by recessing a part of an outer edge of the pressure receiving portion inward, the first engaging portion engaging with a first engaged portion to restrict the liner from being displaced with respect to the axle box, the first engaged portion projecting from an upper surface of the axle box; and a second engaging portion projecting outward from the pressure receiving portion at an opposite side of the first engaging portion, the second engaging portion engaging with a second engaged portion of the axle box to restrict the liner from being displaced and rotated with respect to the axle box.

According to the above configuration, the liner interposed between the axle box and the spring includes not only the first engaging portion configured to restrict the liner from being displaced with respect to the axle box but also the second engaging portion projecting outward from the pressure receiving portion and configured to restrict the liner from being displaced and rotated with respect to the axle box. With this, the positional displacement of the liner from the pressure receiving portion with respect to the axle box can be prevented. Further, since the second engaging portion of the liner projects outward from the pressure receiving portion, a worker can hold the second engaging portion and attach or detach the liner. Thus, the working property improves.

Advantageous Effects of Invention

According to the present invention, the positional displacement of the liner interposed between the axle box and the spring in the railcar bogie can be prevented while improving the working property when attaching and detaching the liner.

DESCRIPTION OF EMBODIMENTS

Figure 1:
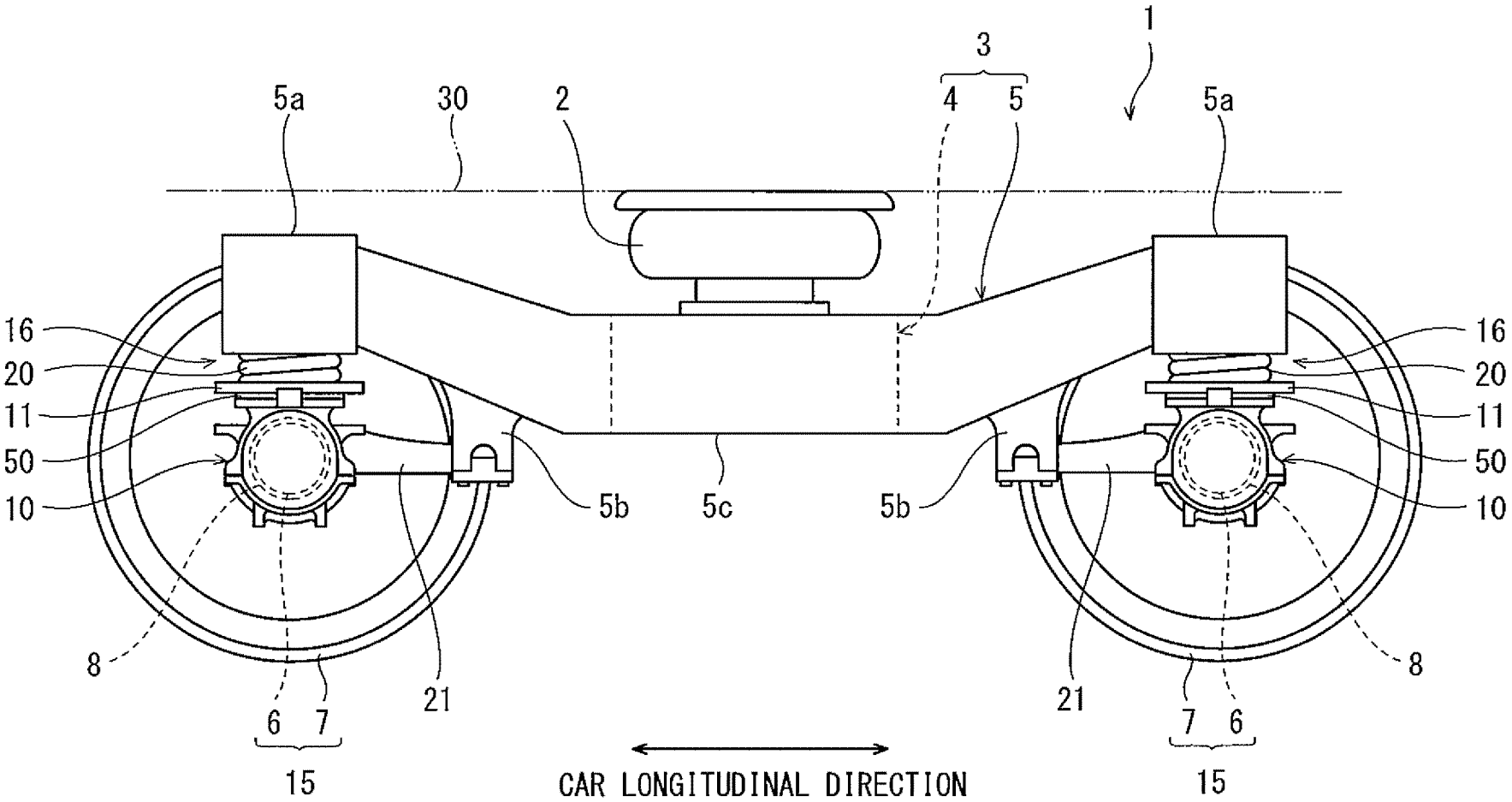
FIG. 1 is a side view of a railcar bogie according to Embodiment 1.

Hereinafter, embodiments will be explained with reference to the drawings. In the drawings, the same reference signs are used for the same or corresponding components, and a repetition of the same explanation is avoided.

Embodiment 1

FIG. 1 is a side view of a railcar bogie 1 according to Embodiment 1. As shown in FIG. 1, the railcar bogie (hereinafter referred to as a "bogie") 1 includes a bogie frame 3 connected to a carbody 30 through an air spring 2. The bogie frame 3 includes: a cross beam 4 extending in a car width direction at a car longitudinal direction middle of the bogie 1; and side sills 5 extending in a car longitudinal direction from both respective car width direction end portions of the cross beam 4.

Axles 6 each extending in the car width direction are arranged at both respective car longitudinal direction sides of the bogie frame 3. Wheels 7 are press-fitted to both respective car width direction sides of each of the axles 6. The axle 6 and the wheels 7 constitute a wheelset 15. A pair of wheelsets 15 provided at the bogie 1 are arranged at both respective car longitudinal direction sides of the bogie frame 3 so as to be spaced apart from each other. Bearings 8 rotatably supporting the wheels 7 are provided at both respective car width direction end portions of each axle 6 so as to be located outside the wheels 7 in the car width direction. The bearings 8 are accommodated in respective axle boxes 10.

Each of the axle boxes 10 is elastically coupled to the bogie frame 3 through a corresponding axle box suspension 16. The axle box suspension 16 includes an axle spring 20 and an axle beam 21. The axle spring 20 connects the axle box 10 and a car longitudinal direction end portion 5*a* of the side sill 5 in an upward/downward direction. The axle beam 21 couples the axle box 10 and a receiving seat 5*b* of the side sill 5 in the car longitudinal direction. The axle beam 21 is formed integrally with the axle box 10 and extends from the axle box 10 toward the cross beam 4 in the car longitudinal direction. A tip end portion of the axle beam 21 is coupled to the receiving seat 5*b* through a rubber bushing and a core rod (not shown), the receiving seat 5*b* being provided at the side sill 5. The receiving seat 5*b* is provided so as to project downward from a part of a lower surface 5*c* of the side sill 5, the part being located between the axle box 10 and the cross beam 4 in the car longitudinal direction.

An axle spring seat 11 supporting the axle spring 20 from below is provided between the axle box 10 and the axle spring 20. It should be noted that the axle spring 20 may be directly supported by the axle box 10 without through the axle spring seat 11.

A wheel load adjusting tool 50 is interposed between the axle box 10 and the axle spring 20. The wheel load adjusting tool 50 is a component for adjusting wheel load balance among the wheels 7 in a non-dismantling state of the railcar and is constituted by below-described liners 51 and 52 (see FIG. 4). In the bogie 1, the wheel load adjusting tool 50 is interposed between the axle box 10 and the axle spring seat 11, and this changes an expansion/contraction amount of the axle spring 20, so that the wheel load balance among the wheels 7 is adjusted. In wheel load adjusting work, a pushing-up device 25 (see FIG. 2) configured to push up the axle spring seat 11 is provided at the axle box 10. To realize appropriate wheel load values, a plurality of liners may be used, or a plurality of liners of different thicknesses may be used. In the present embodiment, the two types of liners 51 and 52 that are different in thickness from each other are inserted.

Figure 2:
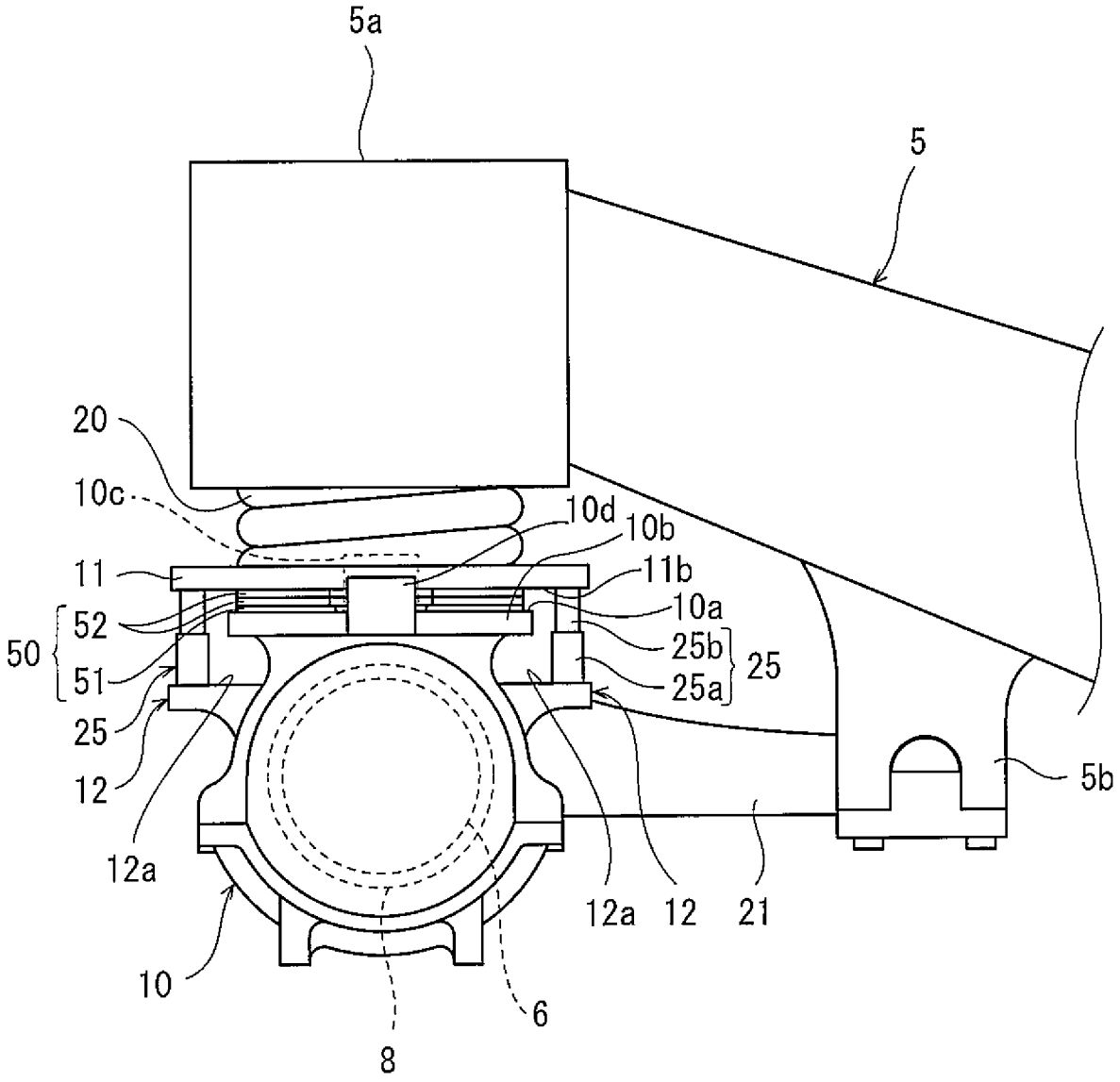
FIG. 2 is a side view showing major components of the bogie with a pushing-up device provided at an axle box shown in FIG. 1.
Figure 3:
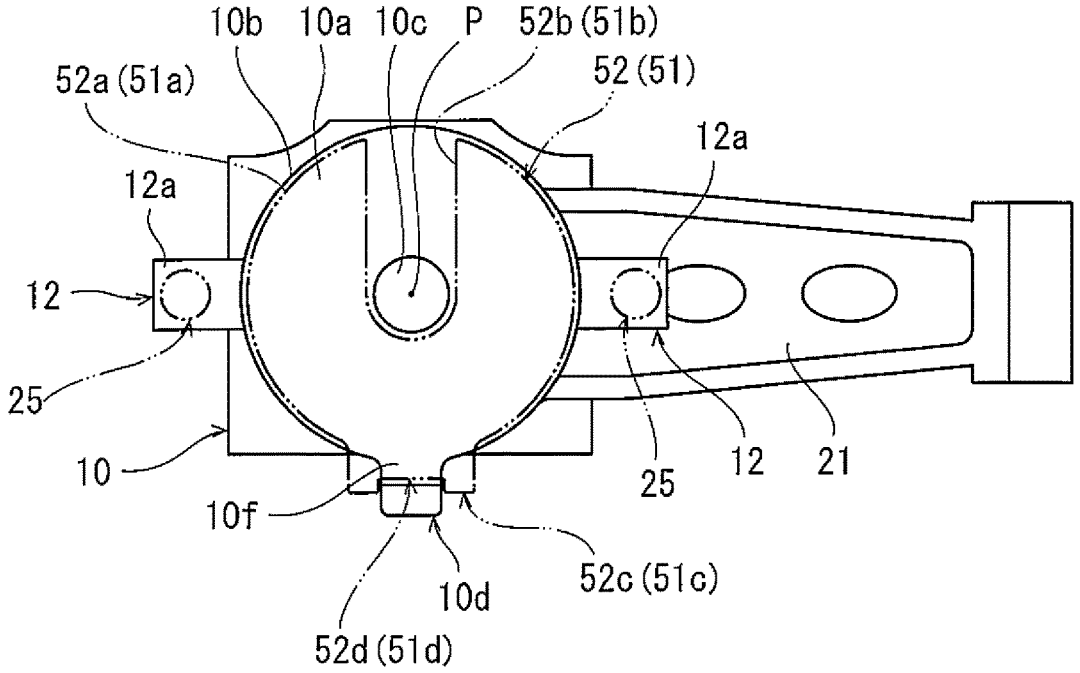
FIG. 3 is a plan view showing the axle box of FIG. 2 and its periphery.

FIG. 2 is a side view showing major components of the bogie 1 with the pushing-up device 25 provided at the axle box 10 shown in FIG. 1. FIG. 3 is a plan view showing the axle box 10 of FIG. 2 and its periphery. As shown in FIGS. 2 and 3, an installation seat 12 at which the pushing-up device 25 is provided is formed integrally with the axle box 10. The installation seat 12 projects from an end portion of the axle box 10 in the car longitudinal direction and is opposed to the axle spring seat 11 in the upward/downward direction. The pushing-up device 25 is provided between an installation surface 12*a* of the installation seat 12 and a lower surface 11*b* of the axle spring seat 11.

In the present embodiment, the pushing-up device 25 is a hydraulic jack. The hydraulic jack 25 includes: a substantially cylindrical cylinder 25*a* including an oil chamber to which operating oil is supplied; and a piston 25*b* which partially projects from an upper surface of the cylinder 25*a*. The piston 25*b* expands and contracts in an axial direction. The pushing-up device 25 is not limited to the hydraulic jack and may be an air jack or the like.

When performing the wheel load adjusting work, a worker places the hydraulic jack 25 between the installation surface 12*a* of the installation seat 12 and the lower surface 11*b* of the axle spring seat 11. When the hydraulic jack 25 is operated, the lower surface 11*b* of the axle spring seat 11 is pushed by the piston 25*b*, and with this, the axle spring seat 11 is pushed upward. Thus, a gap is formed between the axle box 10 and the axle spring seat 11. With this, the liners 51 and 52 can be inserted into the gap, or the inserted liners 51 and 52 can be pulled out from the gap (hereinafter referred to as "the liners 51 and 52 can be attached or detached").

It should be noted that the gap may be formed between the axle box 10 and the axle spring seat 11 by placing the pushing-up device 25 between the car longitudinal direction end portion 5*a* of the side sill 5 and the carbody 30 and pulling the axle spring seat 11 upward. A lifting-up method is not limited to the above.

A first projecting portion 10*c* and a second projecting portion 10*d* are formed at the axle box 10. The first projecting portion 10*c* projects upward from a center of the axle box, and the second projecting portion 10*d* projects upward from a car width direction end portion of the axle box. The first projecting portion 10*c* is substantially columnar and is inserted into a through hole formed at the axle spring seat 11. The second projecting portion 10*d* is formed adjacent to a protruding portion 10*f* of an installation portion 10*b* and projects upward from the protruding portion 10*f*. A car longitudinal direction position of the second projecting portion 10*d* and a car longitudinal direction position of the first projecting portion 10*c* are substantially the same as each other. As described below, the first liner 51 and the second liner 52 engage with the first projecting portion 10*c* and the second projecting portion 10*d*.

The axle box 10 is produced by cutting a metal material (such as an aluminum alloy or carbon steel) formed in a predetermined shape by casting or forging. The first projecting portion 10*c*, the second projecting portion 10*d*, and the installation portion 10*b* are integrally formed by cutting one metal material when producing the axle box 10.

As described above, in the present embodiment, two types of liners that are different in thickness from each other are used. Hereinafter, the structures of the liners will be explained.

Figure 4A:
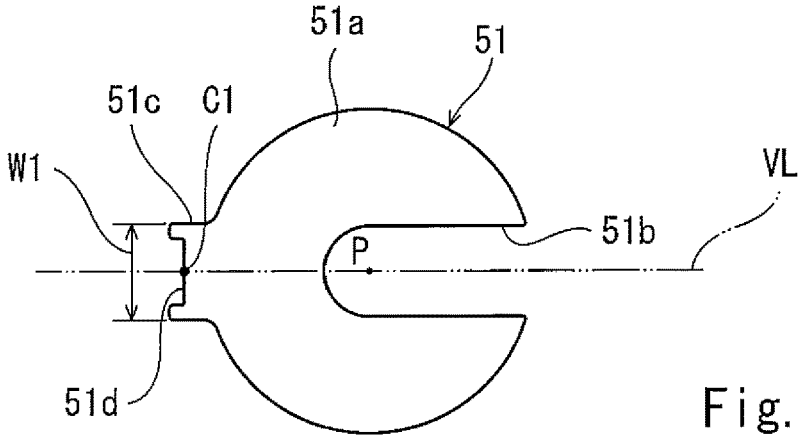
FIG. 4 is a plan view showing first and second liners shown in FIG. 2.
Figure 4B:
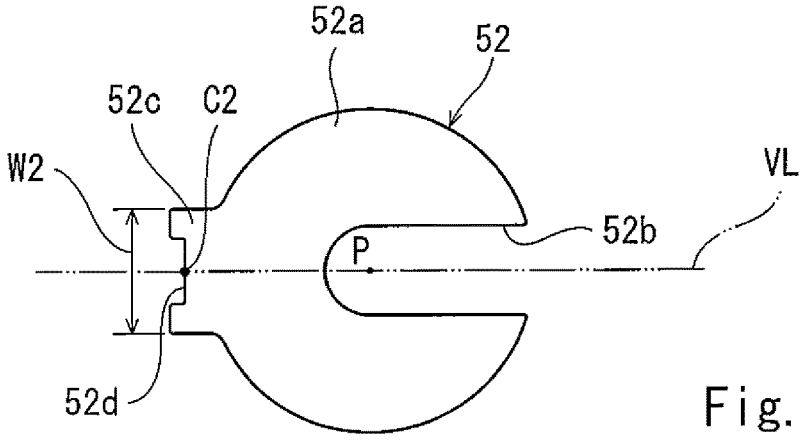

FIG. 4A is a plan view of the first liner 51 shown in FIG. 2. FIG. 4B is a plan view of the second liner 52 shown in FIG. 2. As shown in FIGS. 4A and 4B, the first liner 51 includes a pressure receiving portion 51*a*, a first engaging portion 51*b*, and a second engaging portion 51*c*, and the second liner 52 includes a pressure receiving portion 52*a*, a first engaging portion 52*b*, and a second engaging portion 52*c*. The pressure receiving portions 51*a* and 52*a* receive a load applied from the axle spring 20. In a plan view, each of outer edges of the pressure receiving portions 51*a* and 52*a* has a substantially C shape obtained by cutting out a part of a circle.

The first engaging portion (51*b*, 52*b*) is formed by recessing a part of the outer edge of the pressure receiving portion (51*a*, 52*a*) inward. Specifically, the first engaging portion (51*b*, 52*b*) is recessed toward a center Pin a U shape. The second engaging portion (51*c*, 52*c*) projects outward from the pressure receiving portion (51*a*, 52*a*) at an opposite side of the first engaging portion (51*b*, 52*b*) and includes a concave cutout portion (51*d*, 52*d*) at a tip end of the second engaging portion (51*c*, 52*c*). A cutout width of the cutout portion (51*d*, 52*d*) is set to be equal to or slightly larger than a car longitudinal direction size of the second projecting portion 10*d*. A width direction middle C1 of the second engaging portion 51*c*, a width direction middle C2 of the second engaging portion 52*c*, and the center P are located on a virtual line VL.

A width direction size W1 of the second engaging portion 51*c* of the first liner 51 is smaller than a width direction size W2 of the second engaging portion 52*c*. As above, since the width direction size of the second engaging portion is different depending on the thickness of the liner, a worker can easily distinguish the liners of different types. Further, the work of attaching and detaching the liner is easily performed by holding the second engaging portion as a holding margin with a tool, such as pliers.

As shown in FIGS. 3 and 4, when the liners 51 and 52 are inserted between the axle box 10 and the axle spring seat 11, the first engaging portions 51*b* and 52*b* engage with the first projecting portion 10*c* of the axle box 10, and the second engaging portions 51*c* and 52*c* engage with the second projecting portion 10*d* of the axle box 10.

Since the first engaging portions 51*b* and 52*b* of the liners 51 and 52 engage with the first engaged portion 10*c* located at a center of the axle box 10, the liners 51 and 52 are restricted from being displaced inward in the car width direction and the car longitudinal direction. Further, since the cutout portions 51*d* and 52*d* of the second engaging portions 51*c* and 52*c* fit the second engaged portion 10*d* provided at a car width direction outer end portion of the axle box 10, the liners 51 and 52 are restricted from being displaced with respect to the axle box 10 outward in the car width direction. Furthermore, since the concave cutout portions 51*d* and 52*d* fit the second engaged portion 10*d*, the liners 51 and 52 are restricted from being displaced rotationally about a center of the first engaged portion 10*c*.

Figure 5:
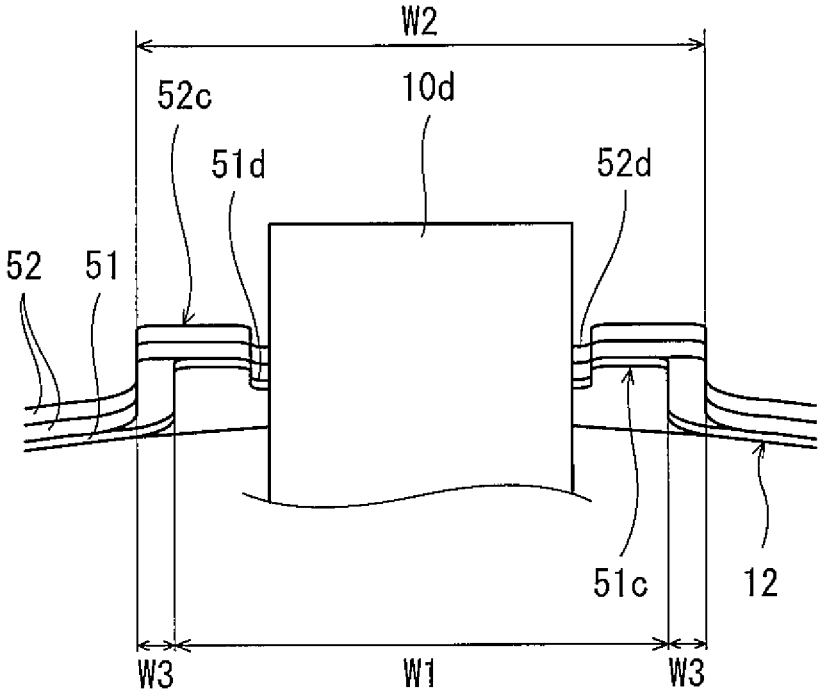
FIG. 5 is a diagram showing that one first liner and two second liners are inserted into the axle box shown in FIG. 2.

FIG. 5 is a diagram showing that one first liner 51 and two second liners 52 are inserted into the axle box 10. As shown in FIG. 5, the thin first liner 51 is inserted under the thick second liner 52 and is sandwiched by the axle box 10 and the second liner 52. Since the width direction size W1 of the cutout portion 51*d* of the first liner 51 is smaller than the width direction size W2 of the cutout portion 52*d* of the second liner 52 as described above, a level difference portion W3 is formed between the second engaging portion 51*c* of the first liner 51 and the second engaging portion 52*c* of the second liner 52. With this, a worker can easily pull out the desired liner by holding the second engaging portion.

The wheel load adjusting tool 50 of the bogie 1 configured as above has the following effects.

By the first engaging portions 51*b* and 52*b* formed at the axle box 10, the liners 51 and 52 are restricted from being displaced inward in the car width direction and the car longitudinal direction. Further, by the second engaging portions 51*c* and 52*c* formed at the axle box, the liners 51 and 52 are restricted from being displaced outward in the car width direction and being displaced rotationally with respect to the axle box 10. With this, the positional displacements of the liners 51 and 52 can be prevented. Further, since the second engaging portions 51*c* and 52*c* and the level difference portion W3 project outward, a worker can hold the second engaging portions 51*c* and 52*c* and attach or detach the liners 51 and 52. Thus, the working property improves.

In the present embodiment, the second engaging portion (51*c*, 52*c*) includes the concave cutout portion (51*d*, 52*d*) at a projecting direction tip end of the second engaging portion, the concave cutout portion fitting the second engaged portion 10*d* of the axle box 10. With this, the displacements and rotations of the liners 51 and 52 can be restricted by a simple configuration. Further, since the concave cutout portion (51*d*, 52*d*) is formed at a projecting end of the second engaging portion (51*c*, 52*c*), a worker can visually confirm whether or not the liners 51 and 52 are surely inserted into the axle box 10.

The width direction middle C1 of the second engaging portion 51*c*, the width direction middle C2 of the second engaging portion 52*c*, the center P of the pressure receiving portion 51*a*, and the center P of the pressure receiving portion 52*a* are located on the virtual line VL. With this, as compared to a conventional case where a projecting piece is fixed to an outer edge of an upper surface of the axle box by welding or the like, the positional displacements of the liners 51 and 52 with respect to the axle box 10 can be easily and satisfactorily prevented.

The first liner 51 and the second liner 52 which are different in thickness from each other include the respective second engaging portions 51*c* and 52*c* which are different in outer shape size from each other. In the present embodiment, the second engaging portion 52*c* of the second liner 52 is larger in width direction size than the second engaging portion 51*c* of the first liner. Therefore, when the first liner 51 and the second liner 52 are inserted into the axle box 10, the second engaging portion 51*c* of the first liner 51 and the second engaging portion 52*c* of the second liner 52 form a level difference. On this account, a worker can easily recognize a thickness difference between the liners 51 and 52 and can easily hold the second engaging portion of the desired liner. With this, the liner having a desired thickness among the plurality of liners 51 and 52 can be easily pulled out.

A thinner liner is first inserted on the upper surface of the axle box 10, and a thicker liner is then inserted. Therefore, the thinner liner can be prevented from falling from the axle box 10. Since the outer shape of an upper layer is larger among the outer shapes of the second engaging portions 51*c* and 52*c* stacked on each other, a worker can easily hold the upper liner, and the work of pulling out the liner is also easy.

The second engaged portion 10*d* is located adjacent to the installation portion 10*b* of the axle box 10 and includes a car width direction outer end portion projecting upward, and the second engaging portions 51*c* and 52*c* engage with the second engaged portion 10*d*. Therefore, the positional displacements of the liners 51 and 52 can be prevented by a simple configuration. The installation portion 10*b* and the second engaged portion 10*d* in the axle box 10 are formed integrally by cutting one metal material when producing the bogie 1. With this, work man-hours can be made smaller than a case where a separate second engaged portion is joined to an installation portion by welding.

Embodiment 2

A bogie 201 according to Embodiment 2 is obtained by partially modifying, for example, the configuration of the bogie frame 3 of the bogie 1 according to Embodiment 1. Hereinafter, differences of the bogie 201 according to Embodiment 2 from the bogie 1 according to Embodiment 1 will be mainly explained.

Figure 6:
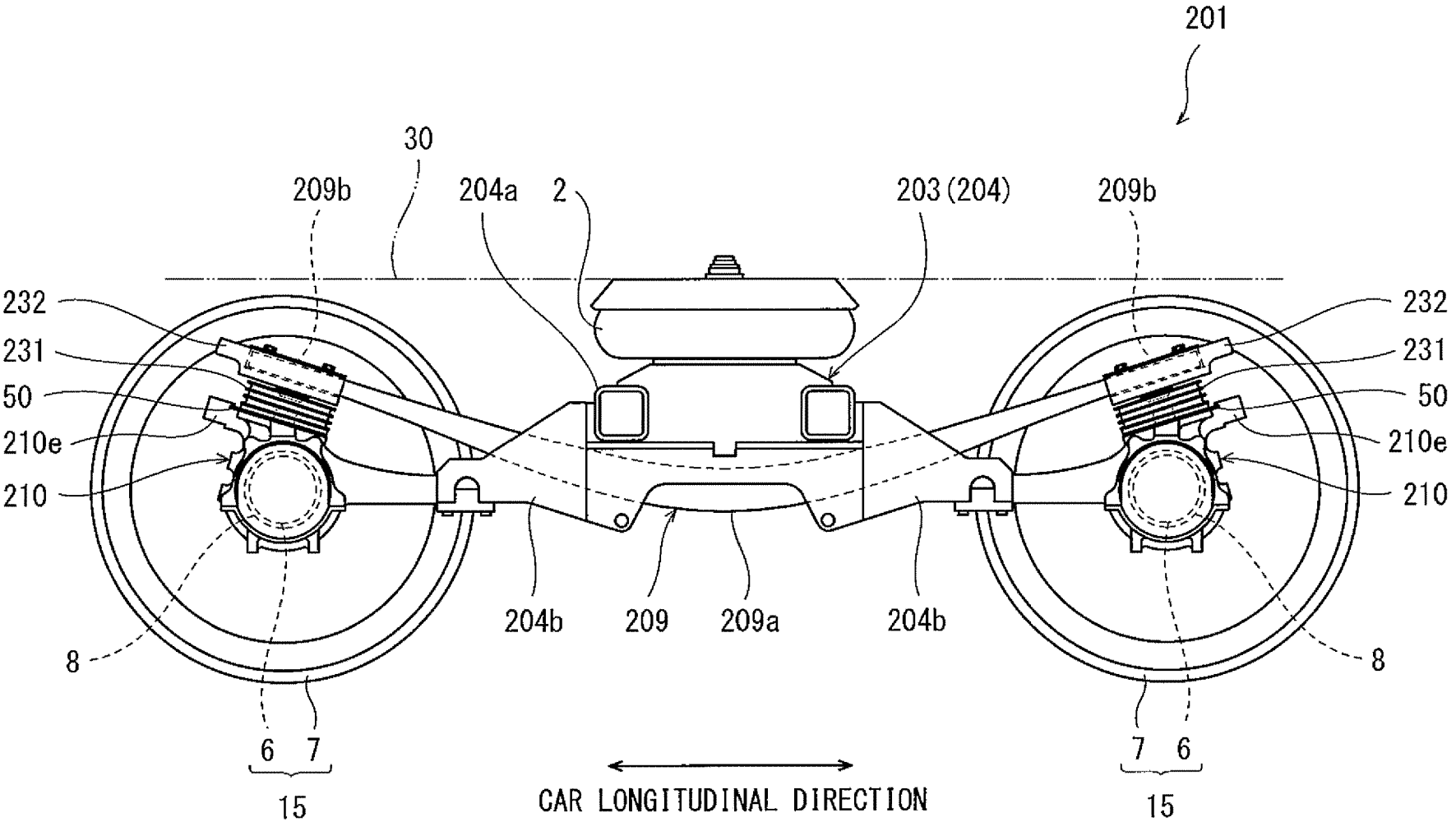
FIG. 6 is a side view of the railcar bogie according to Embodiment 2.

FIG. 6 is a side view of the bogie 201 according to Embodiment 2. As shown in FIG. 6, a bogie frame 203 includes a cross beam 204 extending in a car width direction at a car longitudinal direction middle of the bogie 201. However, unlike the configuration of the bogie frame 3 of Embodiment 1, the bogie frame 203 does not include side sills extending in a car longitudinal direction from both respective car width direction end portions 204*a* of the cross beam 204. A receiving seat 204*b* to which a tip end portion of an axle beam 221 is coupled is formed at the car width direction end portion 204*a* of the cross beam 204.

Each of plate springs 209 extends between an axle box 210 and the cross beam 204 in the car longitudinal direction. Car longitudinal direction middle portions 209*a* of the plate springs 209 support the both respective car width direction end portions 204*a* of the cross beam 204 from below. Car longitudinal direction end portions 209*b* of the plate springs 209 are supported by the respective axle boxes 210. To be specific, the plate spring 209 has both the function of the axle spring 20 (primary suspension) of Embodiment 1 and the function of the side sill 5 of Embodiment 1.

The car longitudinal direction end portion 209*b* of the plate spring 209 is supported by the axle box 210 from below through a vibrationproof rubber unit 231 and a receiving member 232. To be specific, the plate spring 209 is indirectly supported by the axle boxes 210. The vibrationproof rubber unit 231 is substantially columnar and is provided at an upper portion of the axle box 210. The vibrationproof rubber unit 231 is constituted by: a plurality of rubber plates 231*a*; and a plurality of metal plates 231*b* interposed among the plurality of rubber plates 231*a* (see FIG. 2). An upper surface of the vibrationproof rubber unit 231 is inclined obliquely downward toward a middle side in the car longitudinal direction. It should be noted that the upper surface of the vibrationproof rubber unit 231 does not have to be inclined as long as the upper surface of the vibrationproof rubber unit 231 is substantially parallel to a lower surface of the car longitudinal direction end portion 209*b* of the plate spring 209.

The receiving member 232 is provided at an upper portion of the vibrationproof rubber unit 231 and supports the car longitudinal direction end portion 209*b* of the plate spring 209 from below. A spring seat 210*e* is formed integrally with the axle box 210 and includes an upper surface that is in surface contact with a lower surface of the vibrationproof rubber unit 231. The upper surface of the spring seat 210*e* is also substantially parallel to a lower surface 209*c* of the plate spring 209 and is inclined obliquely downward toward the middle side in the car longitudinal direction.

In the bogie 201, the wheel load adjusting tool 50 is interposed between the plate spring 209 and the axle box 210 which transfer a load from the carbody 30 to the wheels 7, and with this, the wheel load balance among the wheels 7 is adjusted in the non-dismantling state of the railcar. In the present embodiment, the wheel load adjusting tool 50 is interposed between the spring seat 210*e* of the axle box 210 and the vibrationproof rubber unit 231. It should be noted that the wheel load adjusting tool 50 may be interposed between the vibrationproof rubber unit 231 and the receiving member 232. In the wheel load adjusting work, a hydraulic jack 225 (see FIG. 2) configured to push up the lower surface 209*c* of the plate spring 209 is provided at the axle beam 221.

Figure 7:
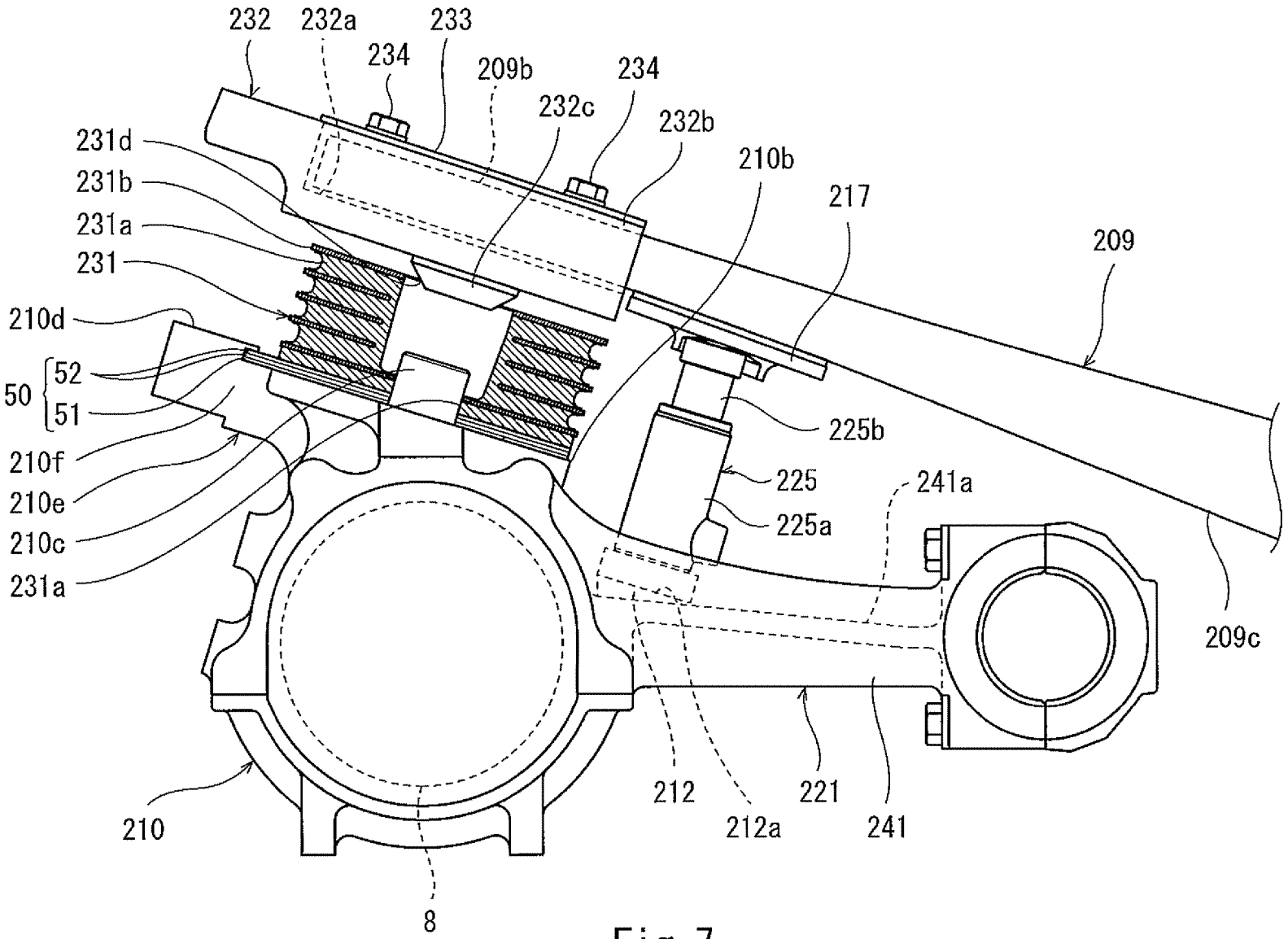
FIG. 7 is a partially sectional side view showing major components of the bogie with the pushing-up device provided at the axle beam shown in FIG. 6.
Figure 8:
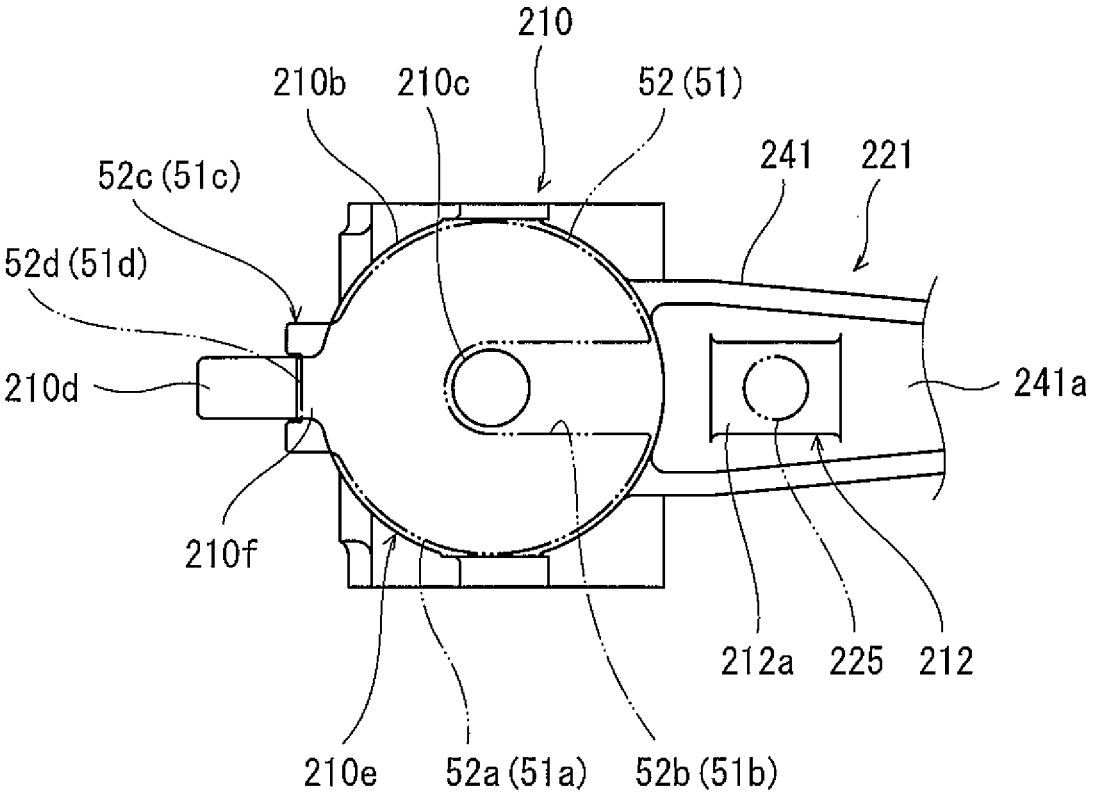
FIG. 8 is a diagram corresponding to FIG. 2 and showing the axle box of FIG. 7 and its periphery.

FIG. 7 is a partially sectional side view showing major components of the bogie 201 with the hydraulic jack 225 provided at the axle beam 221 shown in FIG. 6. FIG. 8 is a diagram corresponding to FIG. 3 and showing the axle box 210 of FIG. 7 and its periphery. As shown in FIGS. 7 and 8, an installation seat 212 is formed on an upper surface 241*a* of an axle beam main body portion 241, and the hydraulic jack 225 can be provided at the installation seat 212. The installation seat 212 includes an installation surface 212*a* on which a lower surface of a cylinder 225*a* of the hydraulic jack 225 is provided. The installation surface 212*a* is substantially parallel to the lower surface 209*c* of the plate spring 209 (and is inclined with respect to a horizontal plane).

As with Embodiment 1, an installation portion 210*b*, a first engaged portion 210*c*, and a second engaged portion 210*d* are formed at the spring seat 210*e* of the axle box 210. The first engaged portion 210*c* is inserted into a lower through hole 231*c* of the vibrationproof rubber unit 231. The second engaged portion 210*d* projects upward from a car longitudinal direction outer end portion of the spring seat 210*e*. Specifically, the second engaged portion 210*d* projects upward from a car longitudinal direction outer protruding portion 210*f* of the installation portion 210*b* (see FIG. 7). The liners 51 and 52 are inserted between the axle box 210 and the vibrationproof rubber unit 231 from an outer side in the car longitudinal direction. It should be noted that the first engaging portions 51*b* and 52*b* of the liners 51 and 52 engage with the first engaged portion 210*c* in the same manner as Embodiment 1, and the second engaging portions 51*c* and 52*c* of the liners 51 and 52 fit the second engaged portion 210*d* in the same manner as Embodiment 1.

As shown in FIG. 7, as a buffer member, a pad 217 made of, for example, rubber is attached to the lower surface 209*c* of the plate spring 209. The pad 217 is attached only when placing the hydraulic jack 225 in the wheel load adjusting work.

The receiving member 232 has a substantially rectangular shape in a plan view and includes a bottom wall portion 232*a*, an outer wall portion 232*b*, and a projecting portion 232*c* projecting downward from a lower surface of the bottom wall portion 232*a*. The projecting portion 232*c* is inserted into an upper through hole 231*d* of the vibrationproof rubber unit 231.

Further, a cover member 233 is fixed to the receiving member 232 by bolts 234. The cover member 233 covers the car longitudinal direction end portion 209*b* of the plate spring 209 from above. When the hydraulic jack 225 pushes up the lower surface 209*c* of the plate spring 209 in the wheel load adjusting work, the receiving member 232 is also pushed up together with the plate spring 209.

When the plate spring 209 and the receiving member 232 are pushed up by the hydraulic jack 225, a gap is formed between the receiving member 232 and the vibrationproof rubber unit 231. Then, by lifting the vibrationproof rubber unit 231, a gap is formed between the vibrationproof rubber unit 231 and the axle box 210, so that the liners 51 and 52 can be attached or detached. Other than the above configuration, Embodiment 2 is the same as Embodiment 1.

Embodiment 2 configured as above has the same effects as Embodiment 1. The liners 51 and 52 are applicable to not only the bogie 1 including the typical bogie frame 3 but also the bogie 201 including the plate spring 209.

The present invention is not limited to the above embodiments, and modifications, additions, and eliminations may be made within the scope of the present invention. In the above embodiments, the width direction sizes W1 and W2 of the second engaging portions 51*c* and 52*c* of the liners 51 and 52 are made different from each other, and with this, the outer shapes of the second engaging portions 51*c* and 52*c* are made different from each other. However, the above embodiments are not limited to this configuration, and the outer shapes of the second engaging portions 51*c* and 52*c* may be any shapes as long as the thickness difference between the liners 51 and 52 is recognizable when the liners 51 and 52 engage with the second engaged portion (10*d*, 210*d*) of the axle box (10, 210). For example, colors of edges of the second engaging portions 51*c* and 52*c* may be made different from each other by painting.

In the above embodiments, there are two types of liners. However, the number of types of liners is not limited to this.

REFERENCE SIGNS LIST

1, 201 railcar bogie
10, 210 axle box
10*b*, 210*b* installation portion
10*c*, 210*c* first engaged portion
10*d*, 210*d* second engaged portion
20 axle spring (spring)
50 wheel load adjusting tool
51 first liner
51*a* pressure receiving portion
51*b* first engaging portion
51*c* second engaging portion
51*d* cutout portion
52 second liner
52*a* pressure receiving portion
52*b* first engaging portion
52*c* second engaging portion
52*d* cutout portion
204 cross beam
209 plate spring (spring)
P center of pressure receiving portion
VL virtual line

The invention claimed is:

1. A wheel load adjusting tool of a railcar bogie,
the wheel load adjusting tool comprising at least one liner interposed between an axle box and a spring directly or indirectly supported by the axle box,
the liner including:
a pressure receiving portion configured to receive a load applied from the spring;
a first engaging portion formed by recessing a part of an outer edge of the pressure receiving portion inward, the first engaging portion engaging with a first engaged portion to restrict the liner from being displaced with respect to the axle box, the first engaged portion projecting from an upper surface of the axle box; and
a second engaging portion projecting outward from the pressure receiving portion at an opposite side of the first engaging portion, the second engaging portion engaging with a second engaged portion of the axle box to restrict the liner from being displaced and rotated with respect to the axle box.

2. The wheel load adjusting tool according to claim 1, wherein a projecting direction tip end of the second engaging portion includes a concave cutout portion to which the second engaged portion is fitted.

3. The wheel load adjusting tool according to claim 1, wherein:
the outer edge of the pressure receiving portion has a substantially C shape forming a part of a circle in a plan view;
the first engaging portion is recessed toward a center of the circle; and
a width direction middle of the second engaging portion is located on a virtual line extending through the center in a direction in which the first engaging portion is recessed.

4. The wheel load adjusting tool according to claim 1, wherein:
the at least one liner comprises a plurality of liners including a first liner and a second liner;
a thickness of the first liner is different from a thickness of the second liner; and
an outer shape of the second engaging portion of the first liner is different from an outer shape of the second engaging portion of the second liner.

5. The wheel load adjusting tool according to claim 4, wherein:
the first liner is thinner than the second liner;
the outer shape of the second engaging portion of the first liner is smaller than the outer shape of the second engaging portion of the second liner; and
the first liner is inserted under the second liner.

6. A railcar bogie comprising:
the wheel load adjusting tool according to claim 1, the wheel load adjusting tool including the at least one liner;
the axle box accommodating a bearing rotatably supporting a wheelset; and
the spring supported by the axle box through the liner,
the axle box including an installation portion at which the pressure receiving portion of the liner is provided,
the second engaged portion being formed adjacent to the installation portion and projecting upward.

7. The railcar bogie according to claim 6, wherein the spring is a plate spring extending between the axle box and a cross beam in a car longitudinal direction.

8. A method of manufacturing the railcar bogie according to claim 6,
the method comprising
integrally forming the second engaged portion and the installation portion by cutting one metal material.

* * * * *